US005544436A

United States Patent [19]

Lefkowitz

[11] Patent Number: 5,544,436

[45] Date of Patent: Aug. 13, 1996

[54] MULTI-PHOTO DISPLAY APPARATUS

[76] Inventor: Jay Lefkowitz, 13312 Ludlow, Huntington Woods, Mich. 48070

[21] Appl. No.: 186,283

[22] Filed: Jan. 25, 1994

[51] Int. Cl.[6] ..... G09F 1/10

[52] U.S. Cl. ..... 40/124.2; 40/497; 40/605; 40/610; 40/611; 40/661; 160/135

[58] Field of Search ..... 40/124.2, 605, 40/610, 611, 661, 152, 152.1, 159, 497, 530; 160/135, 229.1, 236; 211/44

[56] References Cited

U.S. PATENT DOCUMENTS

| | | | |
|---|---|---|---|
| 228,451 | 6/1880 | Doubler | 40/152 |
| 339,173 | 4/1884 | Heaton . | |
| 715,376 | 7/1902 | Harper . | |
| 835,615 | 11/1906 | Henricks . | |
| 846,531 | 3/1907 | Viets . | |
| 1,569,365 | 1/1926 | Goldberg | 40/497 X |
| 1,767,980 | 6/1930 | Hintze . | |
| 2,914,872 | 8/1957 | Goodrich . | |
| 3,460,282 | 8/1969 | Swirsky . | |
| 3,648,393 | 4/1970 | Parrilla . | |
| 4,271,618 | 6/1981 | Lyman | 40/661 X |
| 4,385,459 | 2/1982 | McGrath et al. . | |
| 4,562,656 | 1/1986 | Kristofich . | |
| 4,679,341 | 7/1987 | Goldman | 40/605 X |
| 4,712,322 | 7/1986 | Rubin . | |
| 4,964,231 | 6/1988 | De Maat et al. . | |
| 4,977,696 | 12/1990 | Johansson | 40/605 |
| 4,991,328 | 4/1989 | Rousseau et al. . | |

*Primary Examiner*—Kenneth J. Dorner
*Assistant Examiner*—Cassandra Davis
*Attorney, Agent, or Firm*—Harness, Dickey & Pierce, P.L.C.

[57] ABSTRACT

An apparatus for simultaneously displaying a plurality of photographs, pictures, cards and the like is disclosed. The apparatus incorporates a plurality of display panels having multiple compartments for accommodating any of a variety of standard-sized photographs and the like. Access slots enable the photographs and the like to be easily placed within and removed from the compartment. The photographs may be concurrently displayed in the apparatus at both the front and back of the display panels. Also, additional photographs and the like not for display can be stored in the apparatus. The display panels are connected along their vertical axes by hinge-type joints that enable the display panels to rotate relative to one another, be configured in a variety of display positions and collapse upon one another into a stored position.

12 Claims, 3 Drawing Sheets

MULTI-PHOTO DISPLAY APPARATUS

BACKGROUND AND SUMMARY OF THE INVENTION

1. Field of the Invention

The present invention relates generally to display devices for exhibiting photographs, pictures, cards, and similar items and, more particularly, to an apparatus for displaying a plurality of such items.

2. Discussion

It has long been desirable to provide apparatus intended for displaying or exhibiting photographs, pictures, cards and similar items. To this end, many different types of display racks, picture frames and photograph albums have been designed and produced.

The present invention is directed to an apparatus for simultaneously displaying for view a plurality of photographs, pictures, cards and/or similar items. The multi-photo display apparatus of the present invention incorporates a plurality of display panels that are positioned adjacent to one another and are interconnected along their vertical axes by connection means. The display panels include a transparent front surface and a transparent back surface and incorporate a plurality of compartments in which photographs can be placed for exhibition at both the front and back of the display panels. The compartments can be dimensioned to accommodate any of a variety of standard-sizes of photographs and the like. Access slots enable the photographs and the like to be easily placed in and taken out of the compartments. The connection means are located in between adjacent display panels and enable the display panels to rotate relative to one another so that the display apparatus can be configured in a variety of display positions. Further, when the display apparatus is not in use, the connection means enable the display panels to collapse flat upon one another so as to arrange the apparatus in a stored position.

The multi-photo display apparatus of the present invention can be readily and economically manufactured in a high volume production environment. Suitable materials from which the display apparatus can be made include transparent thermoplastic materials such as an acrylic or polycarbonate. The display apparatus is self-supporting and can be configured in a variety of display positions to enable the viewing of photographs and the like that are displayed in the apparatus simultaneously from many directions, including both the front and back of the display apparatus. Also, the display apparatus provides ready access to the photographs and the like displayed to allow them to be rearranged, removed or replaced quickly and easily. Further, the apparatus is collapsible to a compact storage position while preventing damage to the photographs stored therein.

BRIEF DESCRIPTION OF THE DRAWINGS

The various features and advantages of the present invention will become apparent to one skilled in the art upon reading the following specification, in which.

DESCRIPTION OF THE PREFERRED EMBODIMENT

It should be understood from the outset that while the drawings and following discussion relate to a particular embodiments of the present invention, these embodiments merely represent what is presently regarded as the best mode of practicing the invention and other modifications may be made to the particular embodiments without departing from the spirit and scope of the invention.

Figure 1:
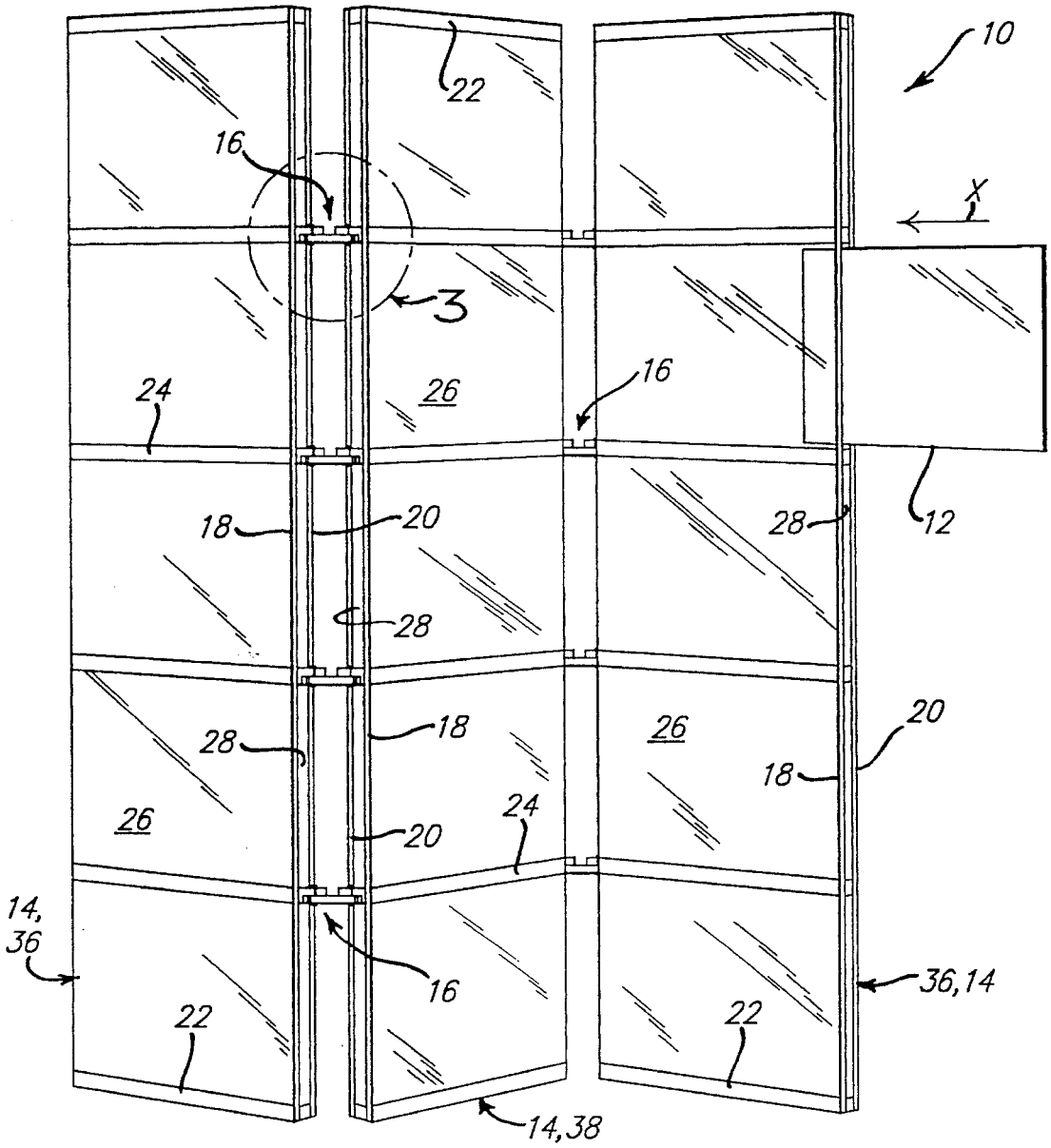
FIG. 1 is a perspective view of a multi-photo display apparatus constructed according to the principles of a first embodiment of the present invention.
Figure 2:
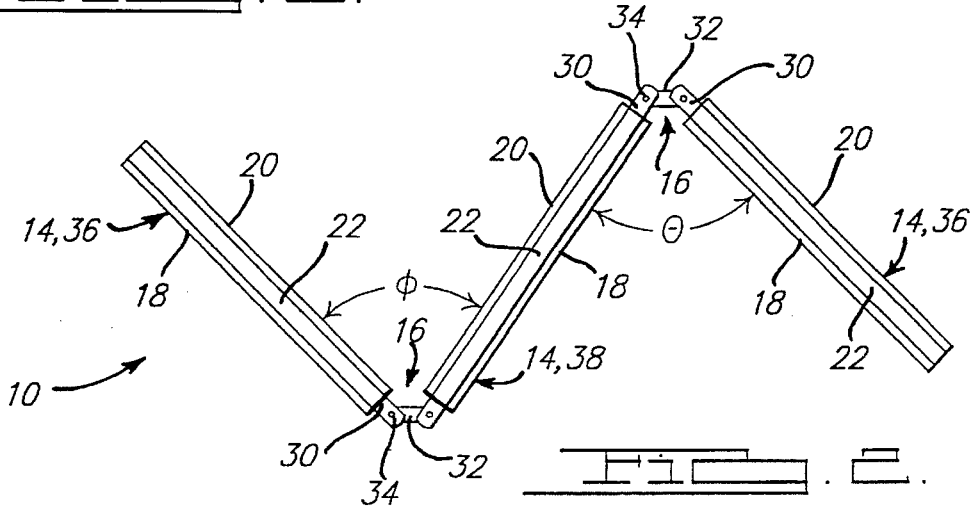
FIG. 2 is a plan view of the multi-photo display apparatus of FIG. 1, showing an arrangement of adjacent display panels.

Referring now to the drawings, a multi-photo display apparatus 10 that is constructed according to the principles of a first embodiment of the present invention is shown in FIGS. 1 through 4. The display apparatus 10, which provides for the simultaneous exhibition of a plurality of photographs, pictures, cards and the like 12, is illustrated in a perspective view in FIG. 1, where it is shown in a self-supporting, vertical standing position. The display apparatus 10 incorporates a plurality of rigid, vertical display panels 14. The display panels 14 are positioned next to one another and are interconnected at a plurality of locations along their adjacent vertical axes by connection means, which are generally indicated at 16. As illustrated in FIGS. 1 and 2, the connection means 16 permit the display panels 14 to rotate relative to one another, as indicated by angles $\phi$ and $\theta$, each of which can independently vary from 0° to 360°. This feature allows the display apparatus 10 to be configured in a variety of display positions. Further, the display apparatus 10 can be expanded and collapsed in a lateral direction and is thereby collapsible to a compact storage position when not in use.

Each display panel 14 of display apparatus 10 includes a transparent front surface 18 and a transparent back surface 20. End divider members 22 are located at opposite vertical ends of the display panels 14, and in between the front and back surfaces 18 and 20. End divider members 22 operate to close off the top and bottom of each display panel 14. A plurality of intermediate divider members 24 are disposed in between the front and back surfaces 18 and 20 and intermediate the end divider members 22. As shown in FIG. 1, the intermediate divider members 24 are positioned at several spaced locations along the vertical distance of the display panel 14.

End divider members 22 and intermediate divider members 24 combine to create a plurality of compartments 26 within each display panel 14 that serve to contain the photographs and the like 12 that are arranged in the display apparatus 10. The compartments 26 can be sized to accommodate any of a variety of standard-sizes for photographs and the like 12, such as 3½ inches by 5 inches or 4 inches by 6 inches, among others. Once arranged in the compartments 26, the display apparatus 10 enables photographs and the like 12 to be viewed through both the transparent front surface 18 and the transparent back surface 20 of the display panels 14. Further, additional photographs and the like 12 which are not desired to be displayed, can be placed within the compartments 26 for storage purposes, in between the photographs and the like 12 that are displayed.

Figure 3:
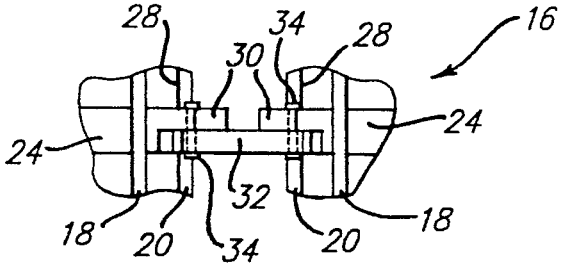
FIG. 3 is an enlarged detail view of a portion of FIG. 1, illustrating connection means located between adjacent display panels.

Access slots or apertures 28 are located in the display panels 14 on at least one side of each compartment 26 and permit the photographs and the like 12 to be easily placed within and taken out of the compartments 26, as illustrated in FIG. 1 at arrow X. For example, as illustrated in FIGS. 1 through 3, both sides of the compartments 26 can have access slots 28 to allow the photographs and the like 12 to be placed within the display apparatus 10 from either side of the compartments 26. Alternatively, access slots 28 can be included on only one side of the compartments 26, with the opposite side of the compartments 26 being completely closed off. In such an instance, placement and removal of the photographs and the like 12 can be accomplished from only a single side of the compartments 26. In this configuration, it is intended that when the display apparatus 10 is collapsed to a storage position, all of the access slots 28 are located on the same side of the display apparatus 10. This serves to facilitate the handling and storage of the display apparatus 10.

Figure 4:
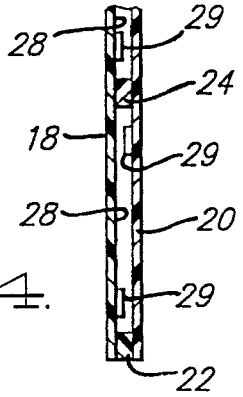
FIG. 4 is a detail view depicting a portion of one end of a display panel.

In addition, the display apparatus 10 can incorporate stop means at one or more of the access slots 28 of each compartment 26, as desired. The stop means serve to prevent the photographs and the like 12 from unintentionally being dislodged or removed from the compartments 26 when the display apparatus 10 is in use, being transported or in storage. However, the stop means do not inhibit easy access to the compartments 26. One such stop means are tab stops 29, which are illustrated in FIG. 4. The tab stops 29 are shown to partially obstruct the access slots 28 in order to prevent unwanted removal of the photographs and the like 12. One or more tab stops 29 can be located at any of a variety of positions about the perimeter of the access slots 28.

As already described, the display panels 14 of the multi-photo display apparatus 10 are interconnected at a plurality of locations along their adjacent vertical axes by connection means 16. As detailed in FIG. 3, the connection means 16 are shown to generally comprise a link-type hinge connection. The connection means 16 include opposing hinge extension portions 30, a hinge link 32 and hinge pins 34. The hinge extension portions 30 extend inwardly toward the connection from the opposing display panels 14. In particular, the hinge extension portions 30 are incorporated at the opposing ends of the intermediate divider members 24 of adjacent display panels 14. The hinge link 32 is pivotally connected to each opposing hinge extension portion 30 by means of the hinge pins 34. As previously mentioned, once the connection is completed the adjacent display panels 14 are able to rotate relative to one another through 360°. Alternatively, connection means 16 can incorporate other well-known hinge-type mechanisms.

Generally, the display apparatus 10 can include two different types of display panels 14, namely, end display panels 36 and intermediate display panels 38. With reference to the embodiment of the present invention that is illustrated in FIGS. 1 and 2, the display apparatus 10 includes two end display panels 36 and a single intermediate display panel 38. As shown, the intermediate divider members 24 of end display panels 36 incorporate only one hinge extension portion 30, extending outward from the display panel 36 and toward the adjacent display panel 14. In contrast, the intermediate divider members 24 of intermediate display panel 38 incorporate two hinge extension portions 30, the hinge extension portions 30 extending outwardly from both sides of the display panel 38 toward the two adjacent display panels 14.

Figure 5:
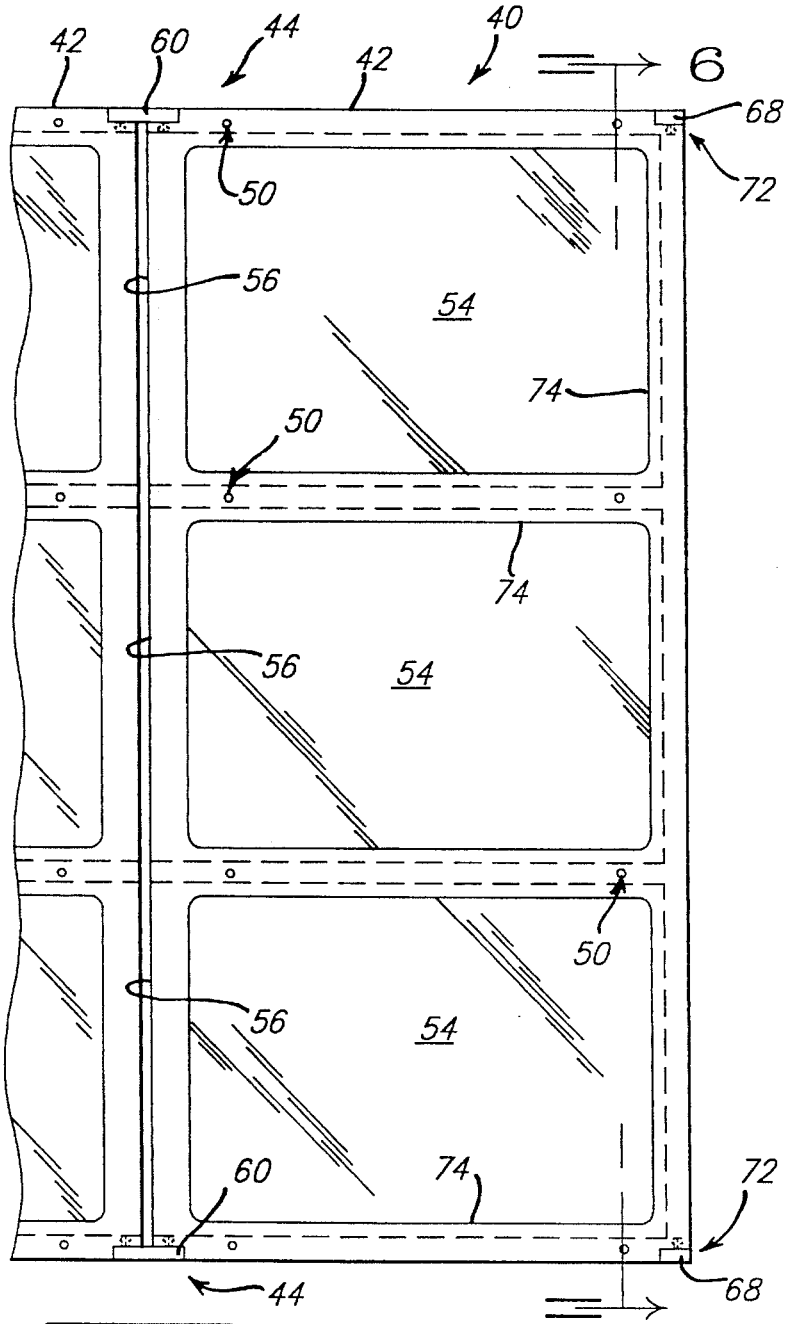
FIG. 5 is a front elevational view of a portion of a multi-photo display apparatus constructed according to the principles of a second embodiment of the present invention.
Figure 6:
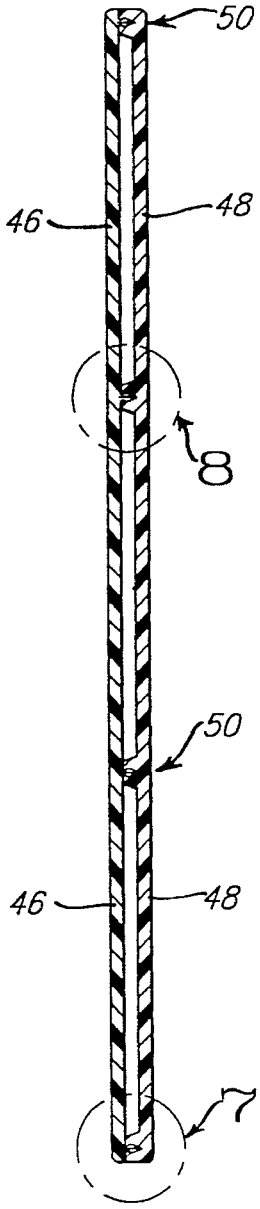
FIG. 6 is a cross-sectional elevation view of the multi-photo display apparatus of FIG. 5 taken along the line 6—6.

Turning now to FIGS. 5 through 12, a multi-photo display apparatus 40 constructed according to the principles of a second embodiment of the present invention is illustrated. A front elevational view showing a portion of a display apparatus 40 is shown in FIG. 5. Similar to the display apparatus 10, the display apparatus 40 incorporates a plurality of rigid display panels 42 that are positioned adjacent to one another and are interconnected along their vertical axes by connection means 44. As already described, connection means 44 allow the display panels 42 to rotate relative to one another and enable display apparatus 40 to be configured in a variety of display positions.

As shown in FIGS. 5 through 8, each display panel 42 has a transparent front section 46 and a transparent back section 48 that are joined by a plurality of snap-fit connections which are generally indicated at 50. Integrally formed within the back section 48 of the display panel 42 are a plurality of dividers 52 which extend along the width of the display panels 42. The dividers 52 serve to close off the top and bottom of the display panels 42 as well as create a plurality of compartments 54 within the display panels 42 to contain the photographs and the like 12 which are placed in the display apparatus 40 for display or storage. As shown in FIG. 5, one side of the compartments 54 include access slots 56 to permit the photographs and the like 12 to be placed within and removed from the compartments 54, while the other side of the compartments 54 are completely closed off. However, display apparatus 40 can alternatively incorporate other access slot configurations, including those having stop means, as has been described above.

Figure 7:
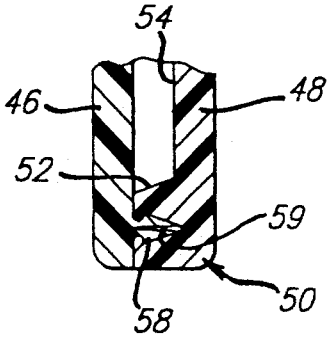
FIG. 7 is an enlarged detail view of a portion of FIG. 6, detailing the connection between the front and back sections of a display panel.
Figure 8:
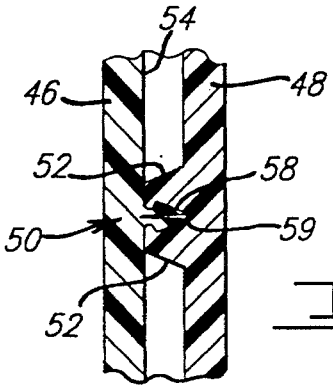
FIG. 8 is an enlarged detail view of a portion of FIG. 6, detailing another connection between the front and back sections of a display panel.
Figure 9A:
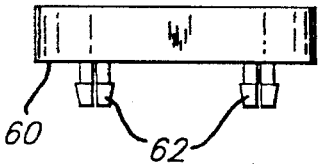
FIG. 9A is a front elevational view of the connection means for the multi-photo display apparatus shown in FIG. 5.
Figure 9B:
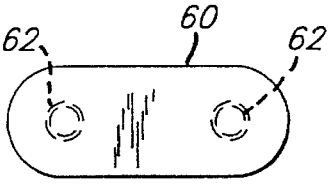
FIG. 9B is a plan view of the connection means of FIG. 9A.

With reference to FIGS. 7 and 8, snap-fit connections 50 comprise a projection portion 58 which is formed on the front section 46 of the display panel 42 and a receptacle portion 59 which is formed in the back section 48 of the display panel 42. Upon assembly of the front and back sections of the display panels 42, the projection portion 58 is inserted or "snapped" into its respective receptacle portion 59 to achieve a mechanical lock which serves to secure the sections of the display panel together.

As best seen in FIGS. 5, 9A, 9B, 11 and 12, a connection means 44 is located at each of the top and the bottom of adjacent display panels 42 and generally comprises a link-type hinge connection having a unitary link member 60. The unitary link member 60 is generally oval in shape and includes two hinge pin projections 62. The hinge pin projections 62 of the unitary hinge link member 60 cooperate with corresponding hinge pin receptacles 64 that are formed in a notch 66 at the corners of each of the display panels 42. Upon insertion of the hinge pin projections 62 into the hinge pin receptacles 64 of the adjacent display panels 42, the unitary hinge link member 60 fills the notch 66 so as to be flush with the respective tops and bottoms of the display panels 42. A mechanical lock is achieved between the hinge pin projections 60 and the hinge pin receptacles 64 which prohibits the unwanted removal of the unitary hinge link member 60 from the display panels 42, but does not inhibit the free rotation of the display panels 42 relative to one another as already described.

Figure 10:
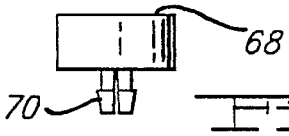
FIG. 10 is a front elevational view of an end cap for the multi-photo display apparatus of FIG. 5.

FIG. 10 shows an end cap 68 which is similar to the unitary hinge link member 60, but has only a single projection 70. The end cap 68 is used to fill the notches 66 that are left at the outer ends 72 of the display apparatus 40, in order to create a pleasing, finished appearance in the display apparatus 40.

The multi-photo display apparatus 40 requires only a single type of display panel 42, which can be utilized either on the ends or intermediate the ends of the display apparatus 40. Thus, additional display panels 42 can be easily added to the display apparatus 40.

If desired, a portion of the exterior surface of the display panels, at both the front and back, can be worked or treated to create an opaque border about the perimeter 74 of the compartments 54. The border enhances the appearance of the display apparatus 40 by creating a matting effect around the photographs and the like 12 that are displayed in the apparatus 40.

As shown in the Figures, the first embodiment of the display apparatus 10 is shown to comprise a three display panel 14 configuration, including two end display panels 36 and a single intermediate display panel 38. However, one of ordinary skill in the art can readily appreciate that the intermediate display panel 38 can be excluded altogether, or that additional intermediate display panels 38 may be incorporated into the display apparatus 10. In a similar manner, the second embodiment of the multi-photo display apparatus 40 can include as many interchangeable display panels 42 as desired. Thus, the present invention is not intended to be limited to having any particular number of display panels 14, 42 in the apparatus 10, 40. Likewise, the Figures show one embodiment of the present invention 10 that incorporates five compartments 26 for photographs and the like 12 in each display panel 14 and another embodiment 40 that includes three compartments 54 for photographs 12 in each display panel 42. Again, however, it should be appreciated by those of ordinary skill in the art that fewer or greater compartments 26, 54 can be used and the present invention is not intended to be limited as including any particular number of compartments 26, 54 in the display panels 14, 42.

Figure 11:
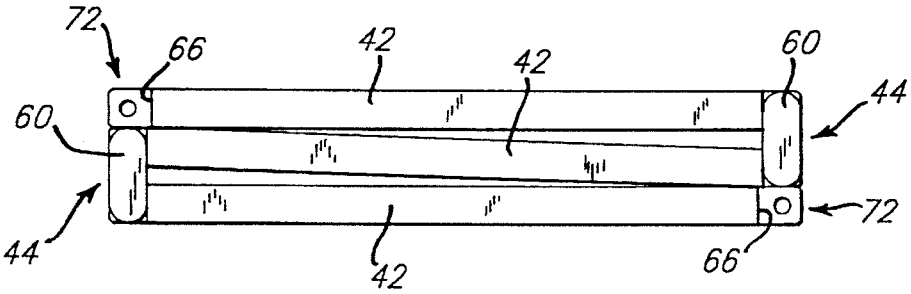
FIG. 11 is a plan view of the multi-photo display apparatus of the present invention shown in a compact storage position.
Figure 12:
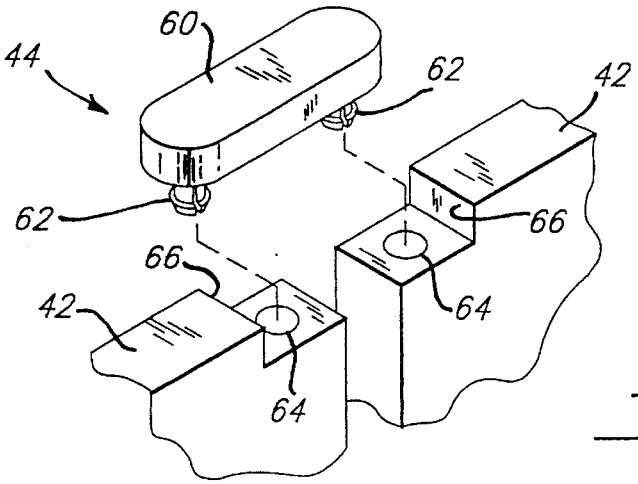
FIG. 12 is a perspective view showing a portion of two adjacent display panels and the connection means of a multi-photo display apparatus of the present invention.

The multi-photo display apparatus 10, 40 is self-supporting and can be configured in a variety of display positions to enable the viewing of a plurality of photographs and the like 12 that are simultaneously displayed in the apparatus 10, 40. Also, ready access to the photographs and the like 12 that are arranged in the display apparatus 10, 40 is provided to allow the photographs and the like 12 to be inserted, rearranged, removed or replaced in the apparatus 10 quickly and easily. Further, as shown in FIG. 11, the multi-photo display apparatus 10, 40 is collapsible to a compact storage position while preventing damage to the photographs that are located therein.

The multi-photo display apparatus 10, 40 of the present invention can be readily and economically manufactured in a high volume production environment using well-known manufacturing methods and techniques including plastic injection molding. An example of a suitable material from which many of the components of the multi-photo display apparatus 10, 40 can be made, including the display panels 14, 42, is a transparent thermoplastic material such as an acrylic or polycarbonate. However, other materials may be incorporated in the apparatus 10, 40 including glass for the surfaces 18 and 20 of the display panels, opaque plastic, metal, wood or another suitable material for the end divider members 22, intermediate divider members 24, and connection means 16, 44. The display apparatus' components can be assembled in a "snap-fit" manner, or can be suitable connected or adhered by any of a variety of methods. Also, a portion of the transparent display panels 14, 42 can be worked or treated to create an opaque border about the perimeter of the compartments 54 causing a matting effect for the photographs and the like 12 that are displayed in the multi-photo display apparatus 40.

The present invention has been described in an illustrative manner. It should be understood that the terminology which has been used is intended to be in the nature of words of description rather than of limitation. Many modifications or variations to the present invention are possible in light of the above teachings. Therefore, within the scope of the following claims, the present invention may be practiced otherwise than as specifically described.

What is claimed is:

1. An apparatus for the simultaneous display of a plurality of photographs, pictures, or cards, comprising:

a plurality of rigid, vertically-arranged display panels, said display panels being positioned laterally adjacent to one another;

each said display panel comprising a front section, a back section, a plurality of divider members and at least one notch located at a corner thereof;

said front section and said back section being joined by first connection means comprising a plurality of projection portions formed in said front section and a corresponding plurality of receptacle portions formed in said back section, said projection portions of said front section being inserted into said receptacle portions of said back section to interlock said front section to said back section;

said plurality of divider members closing said display panel at opposite vertical ends thereof and creating a plurality of compartments within said display panel, each said compartment being dimensioned to receive said photographs, pictures or cards and having at least one access slot to allow said photographs, pictures or cards to be placed within and removed from said compartment; and at least one said display panel being connected directly to an adjacent said display panel by second connection means comprising a link-type hinge connection being pivotally connected at opposite horizontal ends thereof to each of said adjacent display panels, each said hinge connection being disposed within said notch of each said adjacent display panel.

2. The apparatus of claim 1 wherein at least said front section and said back section of said display panels are manufactured from a thermoplastic material.

3. The apparatus of claim 2 wherein at least said thermoplastic material is selected from the group of acrylic and polycarbonate.

4. The apparatus of claim 1 wherein at least some portion of both of said front section and said back section of said display panels is manufactured from glass.

5. The apparatus of claim 1 wherein there are at least three display panels.

6. The apparatus of claim 1 wherein each said display panel includes at least two compartments.

7. The apparatus of claim 1 wherein there are three display panels and each said display panel includes three compartments.

8. The apparatus of claim 1 wherein said compartments are dimensioned about 5 inches long by about 3½ inches high.

9. The apparatus of claim 1 wherein said compartments are dimensioned about 6 inches long by about 4 inches high.

10. The apparatus of claim 1 further comprising stop means located at said at least one access slot of each said compartment.

11. The apparatus of claim 1 wherein said second connection means is located at the opposite vertical ends of said display panels and said second connection means includes a unitary hinge link.

12. The apparatus of claim 1 wherein at least some portion of said front section and said back section of said display panels is opaque.

* * * * *